US009304451B1

(12) United States Patent
Suwabe et al.

(10) Patent No.: US 9,304,451 B1
(45) Date of Patent: Apr. 5, 2016

(54) HEATING TRANSPORT DEVICE, FIXING DEVICE, AND IMAGE FORMING APPARATUS

(71) Applicant: FUJI XEROX CO., LTD., Tokyo (JP)

(72) Inventors: Yasufumi Suwabe, Kanagawa (JP); Nobuhiro Katsuta, Kanagawa (JP); Masaaki Abe, Kanagawa (JP); Satoshi Tatsuura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/815,358

(22) Filed: Jul. 31, 2015

(30) Foreign Application Priority Data

Feb. 25, 2015 (JP) ..... 2015-035601

(51) Int. Cl.
*G03G 15/00* (2006.01)
*G03G 15/20* (2006.01)

(52) U.S. Cl.
CPC ..... *G03G 15/2021* (2013.01)

(58) Field of Classification Search
CPC ..... G03G 15/2017; G03G 15/2021; G03G 15/6573; G03G 15/205; G03G 15/2075; G03G 15/2085; G03G 15/235; G03G 15/657
See application file for complete search history.

(56) References Cited

U.S. PATENT DOCUMENTS

2004/0131397 A1* 7/2004 Kikuchi ..... G03G 15/232 399/309
2007/0059023 A1* 3/2007 Koshida ..... G03G 15/6573 399/92
2007/0140752 A1* 6/2007 Yamamoto ..... G03G 15/2028 399/323
2008/0112736 A1* 5/2008 Kimura ..... G03G 15/2053 399/328
2012/0155906 A1* 6/2012 Barton ..... G03G 15/2042 399/69

FOREIGN PATENT DOCUMENTS

JP 2001-042672 A 2/2001
JP 2008-020483 A 1/2008

* cited by examiner

*Primary Examiner* — Walter L Lindsay, Jr.
*Assistant Examiner* — Jessica L Eley
(74) *Attorney, Agent, or Firm* — Oliff PLC

(57) ABSTRACT

Provided is a heating transport device, including a heating transport roll around which a recording medium to which a toner image is transferred is wound, and that transports the recording medium while heating the toner image to a temperature higher than or equal to a melting temperature of toner, and a cooling roll that forms a nip with the heating transport roll, transports the recording medium, and cools the recording medium such that the temperature of the recording medium is lower than or equal to a heat deformation temperature of the recording medium at a position at which the recording medium separates from the heating transport roll.

9 Claims, 10 Drawing Sheets

HEATING TRANSPORT DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2015-035601 filed Feb. 25, 2015.

BACKGROUND

Technical Field

The invention relates to a heating transport device, a fixing device, and an image forming apparatus.

SUMMARY

According to an aspect of the invention, there is provided a heating transport device, including:

a heating transport roll around which a recording medium to which a toner image is transferred is wound, and that transports the recording medium while heating the toner image to a temperature higher than or equal to a melting temperature of toner; and a cooling roll that forms a nip with the heating transport roll, transports the recording medium, and cools the recording medium such that the temperature of the recording medium is lower than or equal to a heat deformation temperature of the recording medium at a position at which the recording medium separates from the heating transport roll.

BRIEF DESCRIPTION OF THE DRAWINGS

Exemplary embodiments of the present invention will be described in detail based on the following figures, wherein.

Figure 5:
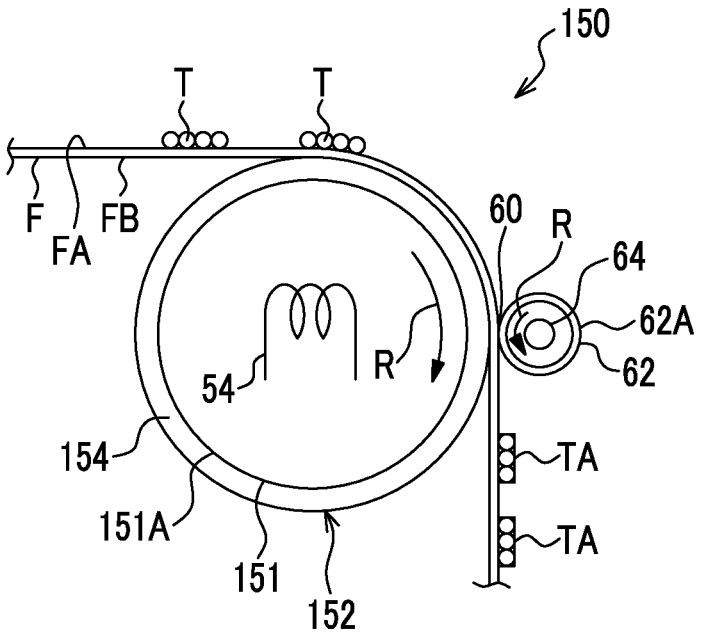
FIG. 5 is a schematic configuration diagram of a first modification example of the heating transport device.
Figure 6:
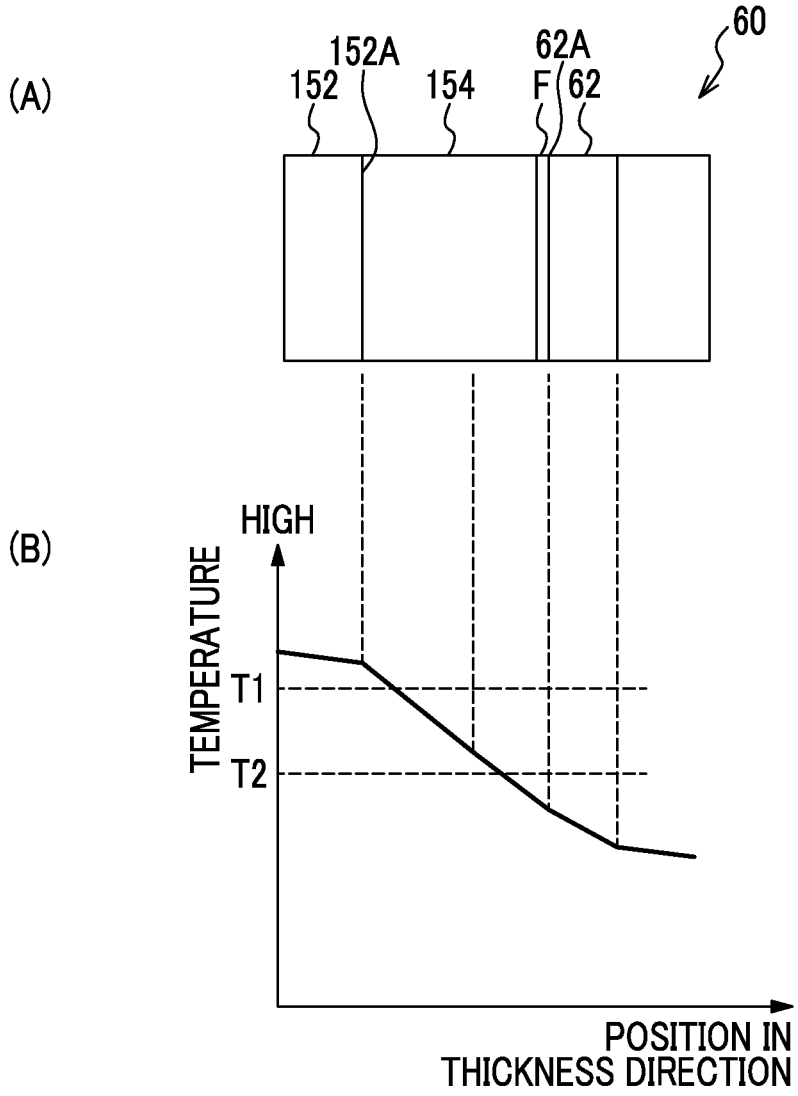
Figure 7:
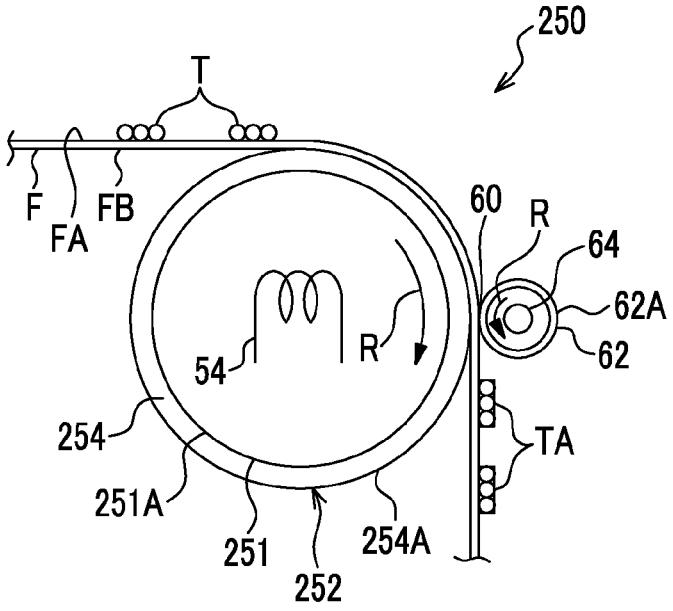
Figure 8:
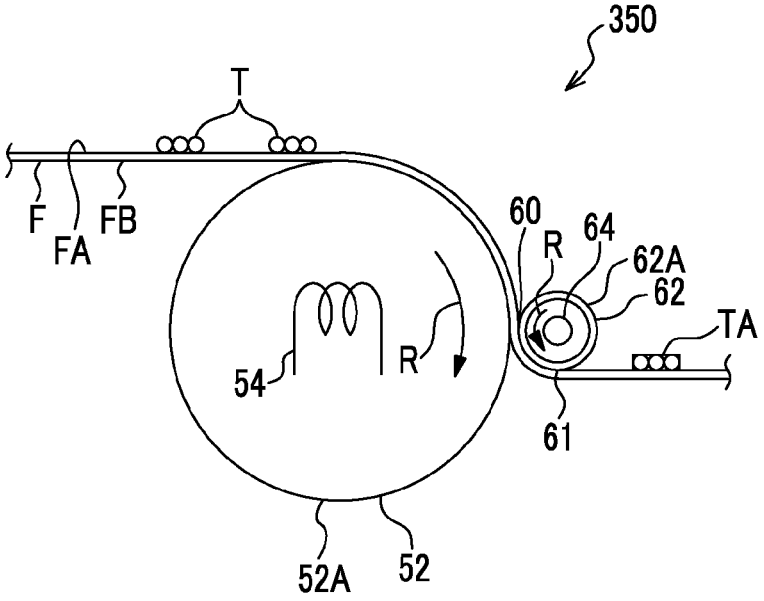
Figure 9:
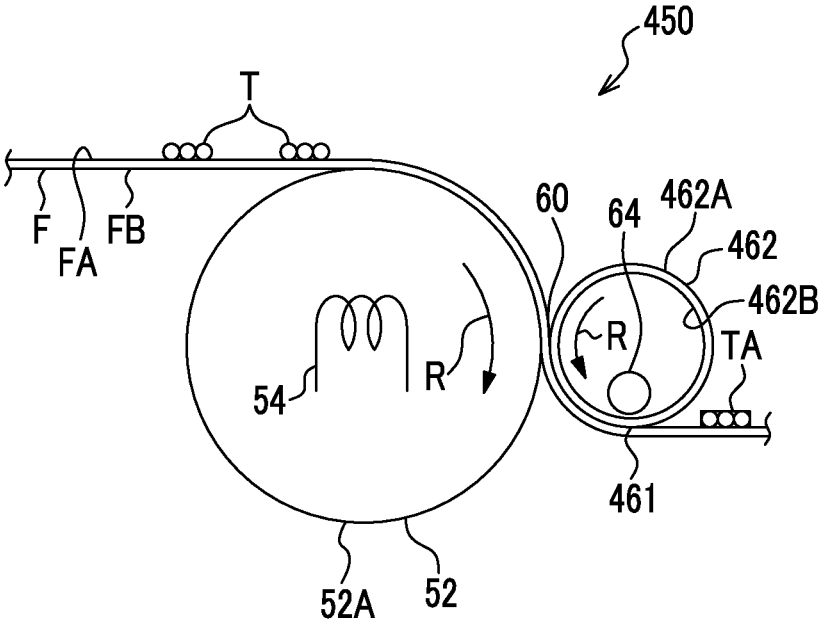
Figure 10:
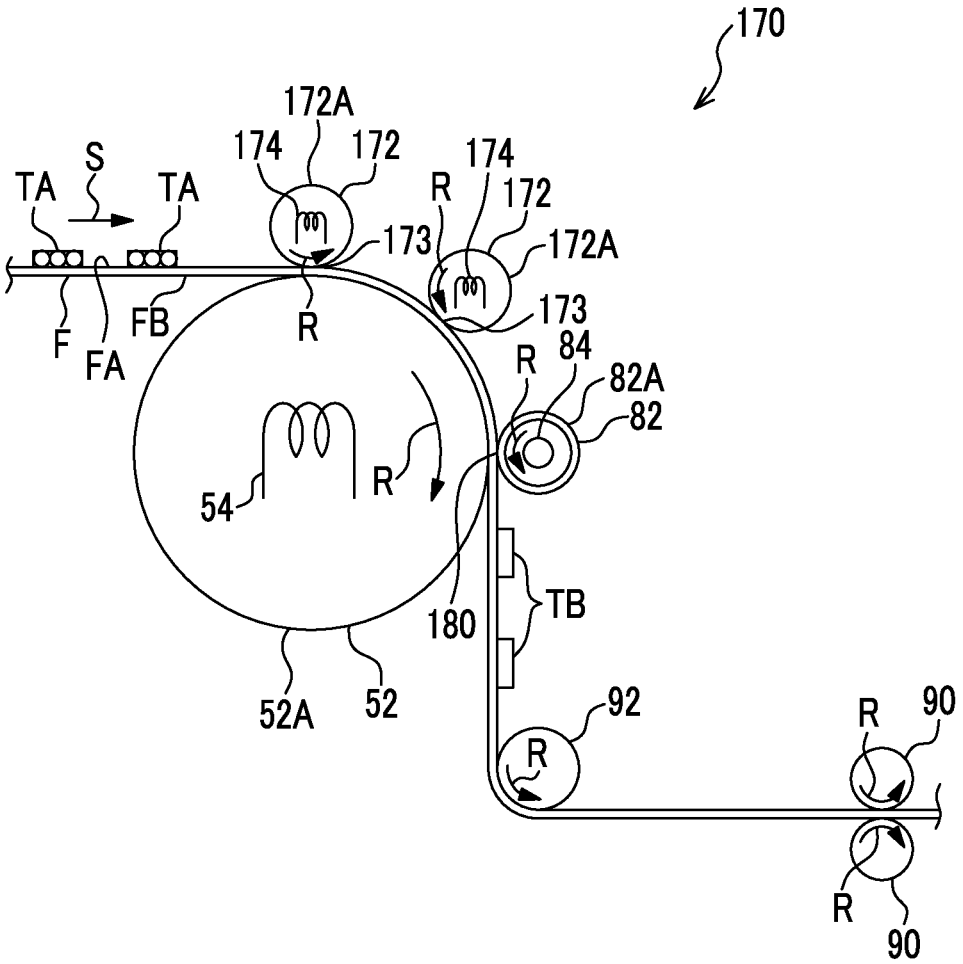
Figure 11:
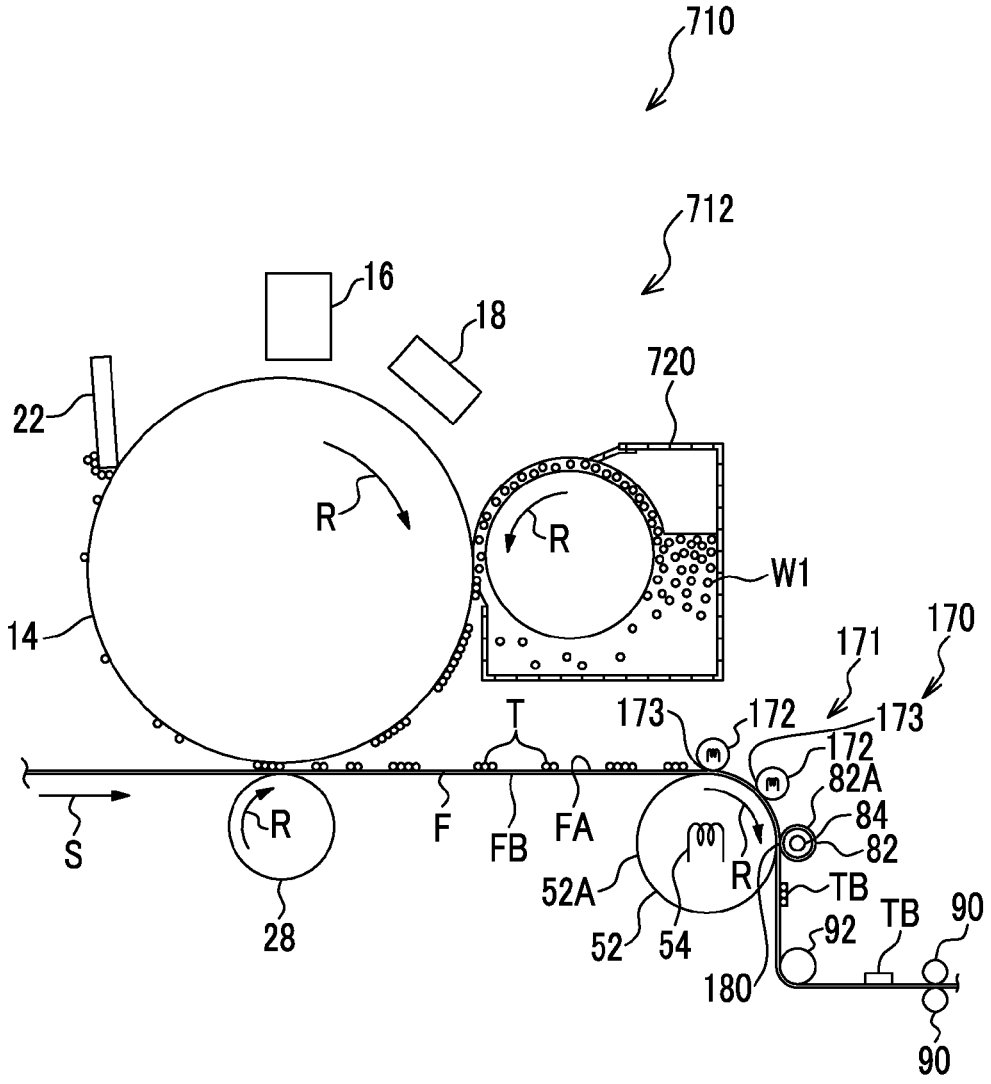

(A) of FIG. 6 is a sectional diagram schematically illustrating the sectional structure in a nip of the heating transport device of the first modification example illustrated in FIG. 5; and (B) of FIG. 6 is a graph illustrating the temperature gradient in the section of (A) of FIG. 6;

FIG. 7 is a schematic configuration diagram of a second modification example of the heating transport device;

FIG. 8 is a schematic configuration diagram of a third modification example of the heating transport device;

FIG. 9 is a schematic configuration diagram of a fourth modification example of the heating transport device;

FIG. 10 is a schematic configuration diagram of a modification example of the fixing device; and FIG. 11 is a schematic configuration diagram of an image forming apparatus of a second exemplary embodiment.

DETAILED DESCRIPTION

First Exemplary Embodiment

In the first exemplary embodiment of the invention, description will be given of an image forming apparatus.

Configuration

Description will be given of the configuration of an image forming apparatus 10 of the present exemplary embodiment. Note that, an arrow R which is depicted in the roll members such as a photoreceptor in the diagrams illustrates the rotational direction of the roll members. An arrow S illustrates the transport direction of a continuous film F (described later).

Figure 1:
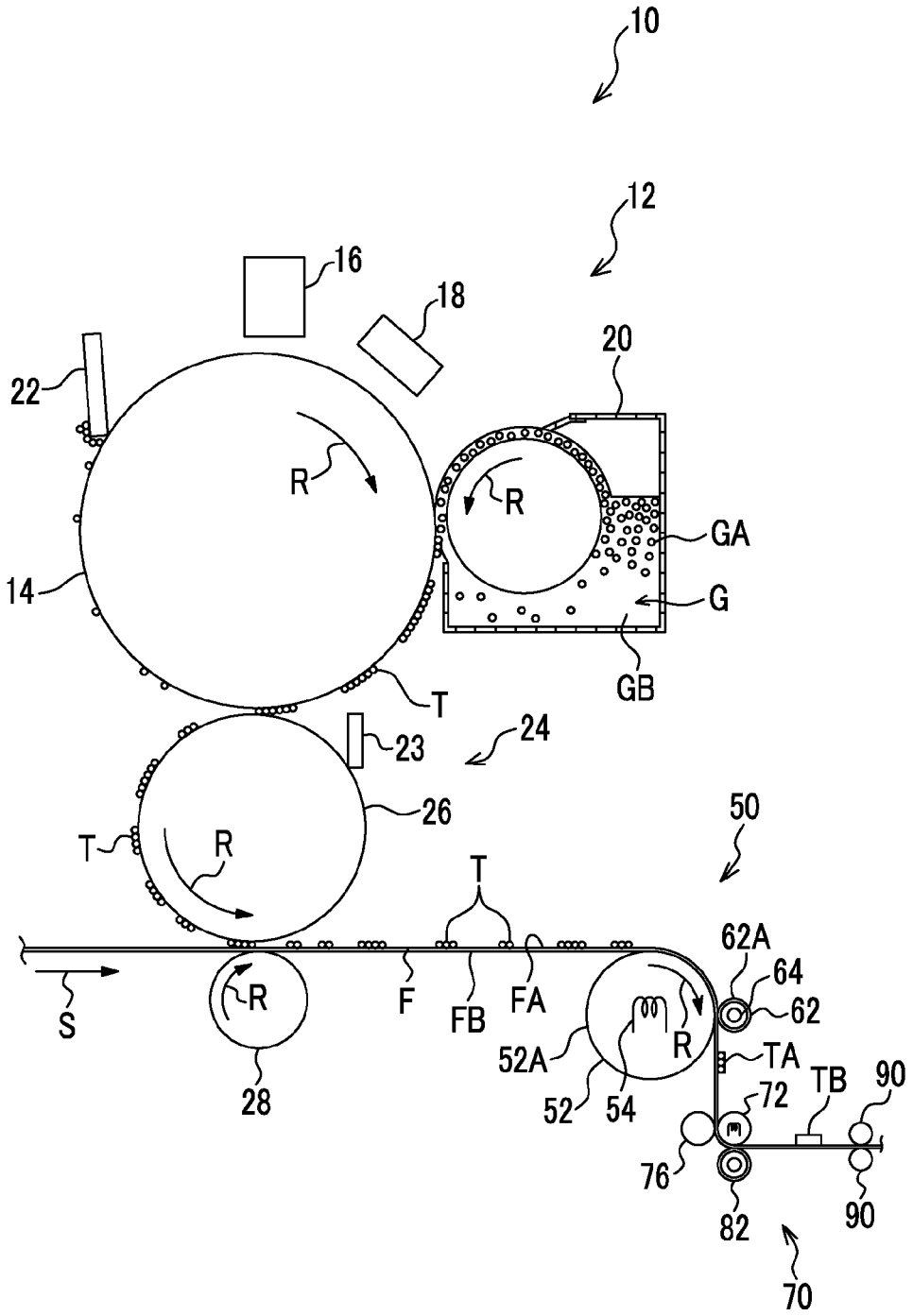
FIG. 1 is a schematic configuration diagram of an image forming apparatus of a first exemplary embodiment.
Figure 2:
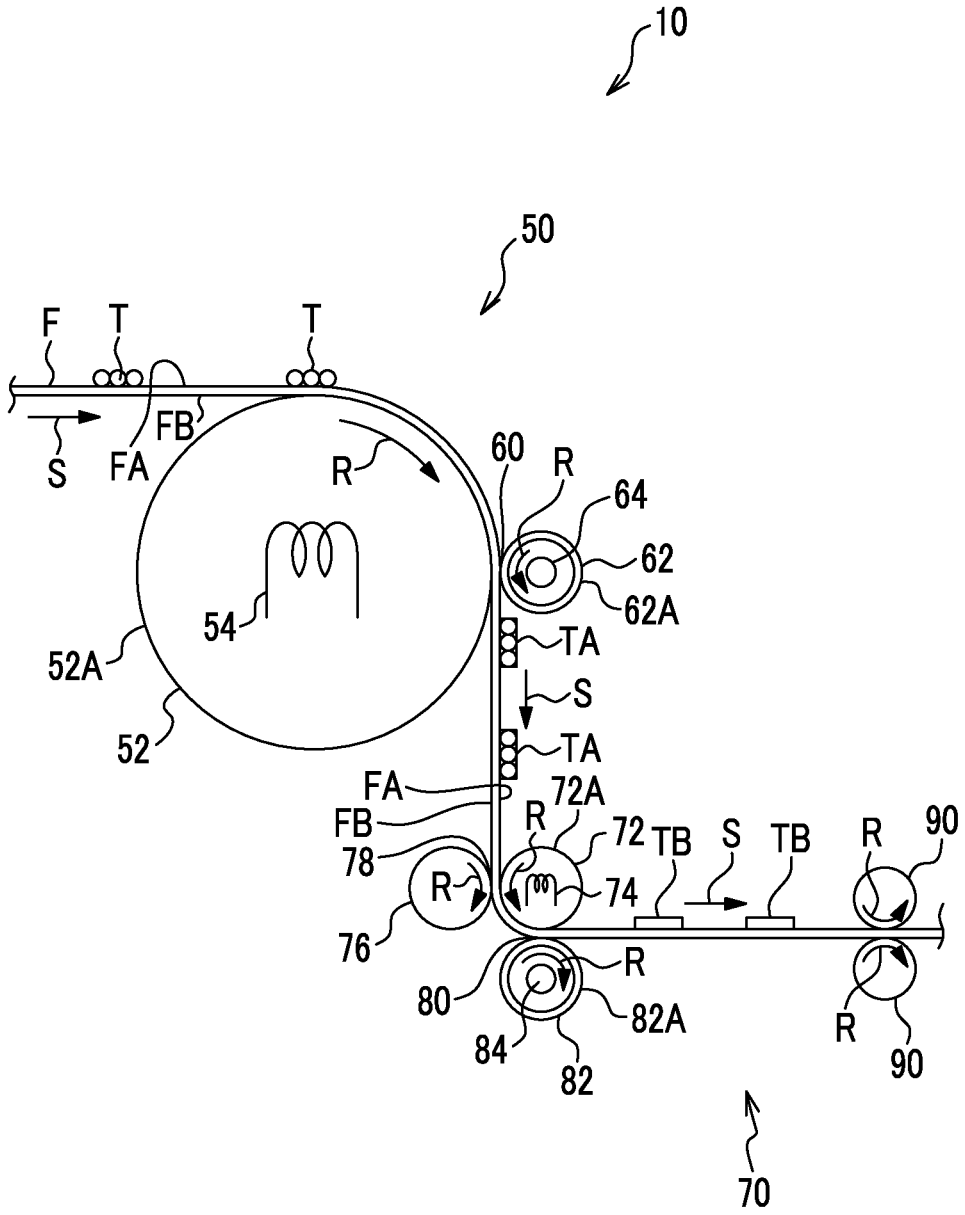
FIG. 2 is a schematic configuration diagram of a heating transport device and a fixing device of the image forming apparatus of the first exemplary embodiment illustrated in FIG. 1.

The image forming apparatus 10 illustrated in FIG. 1 is provided with an image section 12, a heating transport device 50 (also refer to FIG. 2), and a fixing device 70 (also refer to FIG. 2). A delivery device (not shown) is connected to the left side (the upstream side of the continuous film F (described later) in the transport direction) of the image forming apparatus 10 in FIG. 1, and a take-up device (not shown) is connected to the right side (the downstream side of the continuous film F (described later) in the transport direction) of the image forming apparatus 10 in FIG. 1.

The image forming apparatus 10 forms a toner image TB (refer to FIG. 2) on the continuous film F, which is an example of a recording medium, using a liquid developer G. Note that, the liquid developer G is a liquid state developer in which toner particles GA are dispersed in a carrier liquid GB. The continuous film F of the present exemplary embodiment is formed of a resin film, a co-extrusion film, or the like of a material such as polyethylene, polyethylene terephthalate, polypropylene, polystyrene, nylon, cellophane PT.

The continuous film F is wound around the delivery device (not shown) described earlier, and the delivery device includes a function of sending the continuous film F that is wound therearound to the image forming apparatus 10. The take-up device (not shown) described earlier includes a function of taking up the continuous film F on which the toner image TB is formed by the image forming apparatus 10.

Note that, the image forming apparatus 10, the delivery device, and the take-up device are controlled by a control device (not shown).

Image Section

Next, description will be given of the image section 12.

The image section 12 which configures the image forming apparatus 10 illustrated in FIG. 1 forms a toner image T, and transfers the toner image T to the continuous film F. The image section 12 is provided with a photoreceptor 14, a charging device 16, an exposure device 18, a developing machine 20, a transfer device 24, and a photoreceptor cleaning device 22. The transfer device 24 includes a first transfer roll 26, a second transfer roll 28, and a transfer roll cleaning device 23.

Here, description will be given of the process in which the image section 12 forms the toner image T, and transfers the toner image T to the continuous film F.

An electrostatic latent image is formed on the photoreceptor 14 due to the surface of the photoreceptor 14 being charged by the charging device 16 and exposed by the exposure device 18. The electrostatic latent image is developed by the developing machine 20, and the toner image T is formed on the photoreceptor 14. The toner image T which is formed on the photoreceptor 14 is first transferred to the first transfer roll 26 of the transfer device 24, and further, is second transferred to the continuous film F by the second transfer roll 28. The toner which remains on the photoreceptor 14 and the first transfer roll 26 after the transferring is removed and collected by the photoreceptor cleaning device 22 and the transfer roll cleaning device 23, respectively.

Note that, the surface of the continuous film F onto which the toner image T is transferred is an "obverse surface FA", and the surface of the opposite side is a "reverse surface FB".

Heating Transport Device

Next, description will be given of the heating transport device 50.

The heating transport device 50 which configures the image forming apparatus 10 illustrated in FIG. 2 includes a heating transport roll 52, and a cooling roll 62 which is urged by the heating transport roll 52 and forms a nip 60.

The heating transport roll 52 rotates in the arrow R direction and is configured such that an outer circumferential surface 52A thereof assumes a predetermined set temperature due to a heat source 54 which is provided in the inner portion of the roll. The cooling roll 62 rotates in the arrow R direction and is configured such that an outer circumferential surface 62A thereof assumes a predetermined set temperature due to a cooling source 64 which is provided in the inner portion of the roll.

Note that, the cooling source 64 may be configured in any manner; however, in the present exemplary embodiment, the cooling source 64 is a flow path in which a coolant flows through the inner portion thereof. A cooling source 84 described later is also a flow path in which a coolant flows through the inner portion thereof.

The reverse surface FB of the continuous film F is wound around the heating transport roll 52 so as to be in contact with the outer circumferential surface 52A. The continuous film F is interposed between the heating transport roll 52 and the cooling roll 62, is transported, and is configured to separate from the heating transport roll 52 after passing through the nip 60 between the heating transport roll 52 and the cooling roll 62.

In other words, the cooling roll 62 forms the nip 60 at the end portion of the downstream side of the winding range of the continuous film F in the heating transport roll 52. The continuous film F is configured to separate from the heating transport roll 52 and the cooling roll 62 after passing through the nip 60.

Note that, the heating transport roll 52 heats the continuous film F such that the toner image T assumes a temperature higher than or equal to the melting temperature at which the toner image T melts.

Meanwhile, the cooling roll 62 cools the continuous film F at the nip 60 such that the continuous film F assumes a temperature lower than or equal to the heat deformation temperature of the continuous film F. In other words, the temperature of the continuous film F is lower than or equal to the heat deformation temperature thereof at the point in time at which the continuous film F separates from the heating transport roll 52. Note that, the heat deformation temperature of the continuous film F will be described later.

Fixing Device

Next, description will be given of the fixing device 70.

The fixing device 70 which configures the image forming apparatus 10 illustrated in FIG. 2 includes a heating roll 72, a pressure roll 76, and a cooling roll 82. The heating roll 72 is an example of a heating transport roll, and the pressure roll 76 is an example of a fixing roll. A pair of output rolls 90 are provided on the downstream side of the fixing device 70.

The pressure roll 76 and the cooling roll 82 are urged by the heating roll 72 and form a nip 78 and a nip 80, respectively.

The position at which the cooling roll 82 is urged by the heating roll 72 and forms the nip 80 is on the downstream side in the transport direction (an S direction) of the position at which the pressure roll 76 is urged by the heating roll 72 and forms the nip 78.

The heating roll 72 rotates in the arrow R direction and is configured such that an outer circumferential surface 72A thereof assumes a predetermined set temperature due to a heat source 74 which is provided in the inner portion of the roll. The cooling roll 82 rotates in the arrow R direction and is configured such that an outer circumferential surface 82A thereof assumes a predetermined set temperature due to the cooling source 84 (as described earlier, a flow path through which a coolant flows) which is provided in the inner portion of the roll.

The obverse surface FA of the continuous film F is wound around the heating roll 72 so as to be in contact with the outer circumferential surface 72A. The continuous film F is interposed between the pressure roll 76 and the cooling roll 82, is transported, and is configured to separate from the heating roll 72 after passing through the nip 80 between the pressure roll 76 and the cooling roll 82.

Note that, the continuous film F is heated by the heating roll 72 such that the toner image T assumes a temperature higher than or equal to the melting temperature at which the toner image T melts, and is subjected to a pressure by the pressure roll 76. A pre-fixed toner image TA (description will be given of pre-fixing later) is fixed to the obverse surface FA of the continuous film F by the heat and pressure when the toner image TA passes through the nip 78 and becomes the toner image TB.

Meanwhile, the cooling roll 82 cools the continuous film F at the nip 80 such that the continuous film F assumes a temperature lower than or equal to the heat deformation temperature of the continuous film F. In other words, the continuous film F is lower than or equal to the heat deformation temperature thereof at the point in time at which the continuous film F separates from the heating roll 72. Note that, as described earlier, the heat deformation temperature of the continuous film F will be described later.

Operations and Effects

Next, description will be given of the operations and the effects of the present exemplary embodiment.

As illustrated in FIG. 1, the toner image T is transferred by the image section 12 to the obverse surface FA of the continuous film F which is sent to the image forming apparatus 10 from the delivery device (not shown). The continuous film F is sent to the heating transport device 50, the toner image T being transferred to the obverse surface FA of the continuous film F.

As illustrated in FIG. 2, the continuous film F is wound around the heating transport roll 52 of the heating transport device 50, is interposed between the heating transport roll 52 and the cooling roll 62, is transported, and when the continuous film F passes through the nip 60 between the heating transport roll 52 and the cooling roll 62, the continuous film F separates from the heating transport roll 52.

Here, the toner image T contains the carrier liquid GB (refer to FIG. 1) in a state of being transferred to the continuous film F. Due to the continuous film F being heated (preheated) by the heating transport roll 52 to a temperature higher than or equal to the temperature at which the toner image GA (refer to FIG. 1) melts, a portion of the carrier liquid GB (refer to FIG. 1) evaporates, and the toner image T is pre-fixed. Note that, the toner image TA represents the pre-fixed state. The toner image TA which is heated and pre-fixed on the heating transport roll 52 is fused to the obverse surface FA of the continuous film F, and is adhered to the surfaces of the cooling roll 62 and the heating roll 72 in a non-offset state.

The continuous film F is heated by the heating transport roll 52 to a temperature higher than or equal to the melting temperature of the toner; however, when the continuous film F passes through the nip 60 between the heating transport roll 52 and the cooling roll 62, the continuous film F is cooled to a temperature lower than or equal to the heat deformation temperature of the continuous film F, and separates from the heating transport roll 52. The continuous film F which separates from the heating transport roll 52 and is sent from the heating transport device 50 is interposed between the heating roll 72 and the pressure roll 76 of the fixing device 70, and is transported. Note that, the temperature of the surface 52A of the heating transport roll 52 is reduced once to lower than or equal to a set temperature downstream of the nip 60 by the cooling roll 62; however, the surface 52A of the heating transport roll 52 is reheated by the heat source 54 of the inner portion thereof to the set temperature by the next point which comes into contact with the continuous film F.

A tensile force is applied to the continuous film F which is transported in this manner between the heating transport device 50 and the fixing device 70. However, as described earlier, after being cooled to a temperature lower than or equal to the heat deformation temperature by the cooling roll 62, the continuous film F is sent from the heating transport device 50. In other words, the portion of the continuous film F to which the tensile force is applied, between the heating transport device 50 and the fixing device 70, is lower than or equal to the heat deformation temperature. Accordingly, for example, the heat deformation of the continuous film F is suppressed (as described later, the stretching rate is less than or equal to a reference value K) in comparison to a case in which the portion of the continuous film F between the heating transport device 50 and the fixing device 70 is cooled (a case in which the continuous film F is cooled at the position at which the tensile force is applied). A reduction in image quality such as wrinkling caused by heat deformation is suppressed due to the heat deformation of the continuous film F being suppressed.

Next, when the continuous film F onto which the toner image T is pre-fixed by the heating transport device 50 is interposed between the heating roll 72 and the pressure roll 76 of the fixing device 70 and is transported (when the continuous film F passes through the nip 78), the pre-fixed toner image TA is fixed to the obverse surface FA of the continuous film F by the heat and pressure and becomes the toner image TB.

The continuous film F is then cooled to a temperature lower than or equal to the heat deformation temperature in the nip 80 between the heating roll 72 and the cooling roll 82, and separates from the heating roll 72. The continuous film F which is separated from the heating roll 72 is sent from the fixing device 70 and is output by the output rolls 90. Note that, the temperature of the surface 72A of the heating roll 72 is reduced once by the cooling roll 82 to lower than or equal to a set temperature downstream of the nip 80; however, the surface 72A of the heating roll 72 is reheated by the heat source 74 of the inner portion thereof to the set temperature by the next point which comes into contact with the continuous film F.

A tensile force is applied to the continuous film F which is transported in this manner between the fixing device 70 and the output rolls 90. However, as described earlier, after being cooled to a temperature lower than or equal to the heat deformation temperature by the cooling roll 82, the continuous film F is sent from the fixing device 70. In other words, the temperature of the portion of the continuous film F to which the tensile force is applied, between the fixing device 70 and the output rolls 90, is lower than or equal to the heat deformation temperature. Accordingly, for example, the heat deformation of the continuous film F is suppressed (as described later, the stretching rate is less than or equal to the reference value K) in comparison to a case in which the portion of the continuous film F between the fixing device 70 and the output rolls 90 is cooled. A reduction in image quality such as wrinkling caused by heat deformation is suppressed due to the heat deformation of the continuous film F being suppressed.

Heat Deformation Temperature

Next, description will be given of the heat deformation temperature of the continuous film F. Note that, the term "heat deformation" refers to the plastic deformation (permanent deformation) of the heated continuous film F due to a tensile force.

Heat Deformation Testing Device

First, description will be given outlining the heat deformation testing device.

Figure 3A:
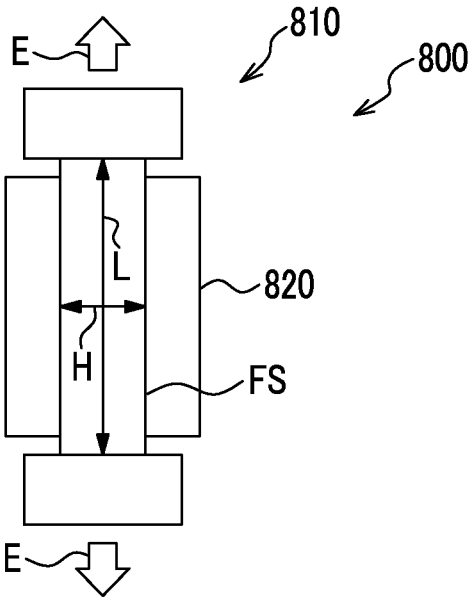
FIG. 3A is a schematic configuration diagram of a testing device which measures heat deformation of a continuous film.

A heat deformation testing device 800 illustrated in FIG. 3A includes a pulling section 810 and a heating section 820. The pulling section 810 pulls a sample FS of the continuous film F as illustrated by an arrow E, and the heating section 820 heats the sample FS. Note that, the pulling section 810 may pull the sample FS and measure the tensile force which is applied to the sample FS. The sample FS of the continuous film F has a width H of 15 mm and a length L of 75 mm. In the present exemplary embodiment, the pulling section 810 may carry out a pulling test which conforms to JIS K-7157. In the present test, Nidec-Shimpo Corporation Test Device FGS-TV is used.

Heat Deformation Testing Method

Next, description will be given of the heat deformation testing method.

Figure 3B:
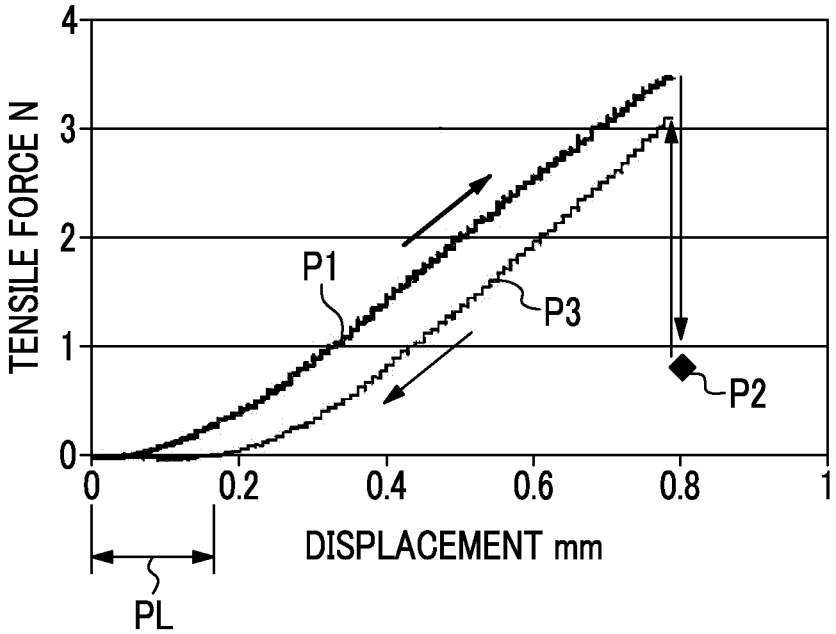
FIG. 3B is a graph of test results.

First, the sample FS is pulled 2 mm per minute at room temperature (25° C.), and the pulling is stopped when a predetermined displacement is reached. The tensile force of the sample FS is measured. Note that, the relationship between the displacement and the tensile force is illustrated by P1 of the graph of FIG. 3B.

The heating section 820 is caused to come into contact with the sample FS for a fixed time. The time is set to the actual heating time within the image forming apparatus 10. For example, in the image forming apparatus 10 of the present example, the heating section 820 is caused to be in contact with the sample FS for 2 seconds, which is the maximum time the toner image TA passes through the heating section 820. The sample FS expands due to being heated, and the tensile force is reduced. The reduced tensile force of this time is illustrated by P2 of the graph of FIG. 3B.

After the heating is stopped, the sample FS contracts due to being cooled (restored) to room temperature (25° C.), and the tensile force is increased. The displacement of the sample FS is restored to the original state, and the displacement amount PL (FIG. 3B) at which the tensile force is 0 (zero) is obtained.

The displacement amount PL is the stretching amount of the sample FS due to heat deformation, and the quotient obtained by dividing the sample FS by the original length L (=75 mm) is the stretching rate.

Figure 4:
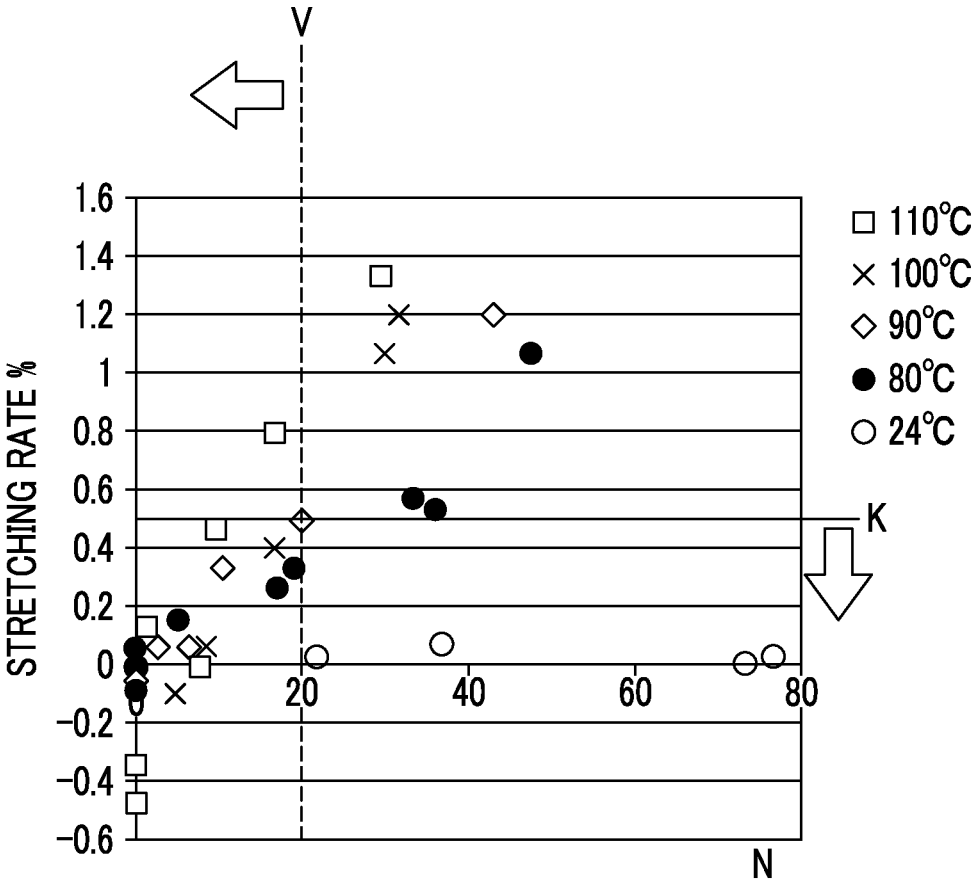
FIG. 4 is a graph summarizing the measurement results of the heat deformation of the continuous film.

The graph illustrated in FIG. 4 is a summary of the results obtained by carrying out the test by changing the heating temperature of the sample FS, with the tensile force which acts on the sample FS converted to the length (in the present example, 500 mm) of the continuous film F to which the tensile force is applied in the image forming apparatus 10.

Note that, FIG. 4 illustrates the measurement results of OPP film which is 20 μm thick, for example.

Here, in the image forming apparatus 10 of the present exemplary embodiment, the reference value (target value) K of the stretching rate due to the heat deformation of the continuous film F and a maximum value V of the tensile force applied to the continuous film F during the heated transport are measured or calculated. Note that, in the image forming apparatus 10, when the continuous film F is subjected to heat deformation (expanding or contracting), the image quality is reduced by the occurrence of wrinkles or the like; however, the stretching rate at which the reduction in the image quality is permissible is the reference value (the target value) K. Note that, the reference value K may be determined, as appropriate, according to the type of image to be formed, the post production such as laminating and cropping, and the object, size, and the like of the film on which the image is formed. In the following exemplary embodiment, description is given using 0.5% as the reference value K.

From the graph illustrated in FIG. 4, the heating temperature at which the stretching rate of the continuous film F is less than or equal to the reference value K at the maximum value V of the tensile force applied to the continuous film F during the heated transport in the image forming apparatus 10 is the "heat deformation temperature of the continuous film F". Note that, in the case of the present exemplary embodiment, since the maximum value V of the tensile force which is applied during the heated transport (in relation to a length of 500 mm) is 20N and the reference value K of the stretching rate is 0.5%, the heat deformation temperature of the continuous film F is 100° C. according to the same graph.

Accordingly, in the present exemplary embodiment, the cooling rolls 62 and 82 are configured to render the temperature of the continuous film F lower than or equal to 100° C., and to be separated from each other. The surface of the cooling roll 62 may be smooth such that the pre-fixed or fixed toner image TA does not adhere thereto, and it is desirable that the surface of the cooling roll 62 is formed of a material with a low surface energy such as a fluorine-based resin (PFA, PTFE, or the like).

Modification Example of Heating Transport Device

Next, description will be given of a modification example of the heating transport device which configures the image forming apparatus 10.

First Modification Example

First, description will be given of the first modification example.

Configuration

A heating transport roll 152 of a heating transport device 150 of the first modification example illustrated in FIG. 5 has a structure which includes a roll main body 151 and a heat resistive layer 154 which is provided on an outer circumference 151A of the roll main body 151. Note that, the roll main body 151 has the same configuration as the heating transport roll 52 (refer to FIG. 2). The heat resistive layer 154 is formed of a material with a larger temperature gradient than the roll main body 151, for example, an elastic body such as rubber. Specifically, the heat resistive layer 154 is formed of silicone rubber which is 2 mm thick.

Operations and Effects (A) of FIG. 6 schematically illustrates the sectional structure of the nip 60 between the heating transport roll 152 and the cooling roll 62 of the heating transport device 150. (B) of FIG. 6 illustrates a graph representing the temperature gradient in the nip 60 corresponding to the sectional structure. Note that, T1 is the melting temperature at which the toner melts, and T2 represents the heat deformation temperature.

In this manner, the heat resistive layer 154 is present between the high temperature roll main body 151 and the continuous film F (the low temperature cooling roll 62), and a large temperature gradient arises in the heat resistive layer 154. A point which assumes the temperature T2 may be provided in the heat resistive layer 154. Accordingly, the continuous film F is effectively cooled to a temperature lower than or equal to the heat deformation temperature through the entire thickness direction thereof in comparison with a case in which the heat resistive layer 154 is not present. Note that, the temperature of the continuous film F is the surface temperature (T1 or higher) of the heating transport roll 152 before the nip 60; however, when the continuous film F enters the nip 60, the heat thereof is taken by the cooling roll 62 due to the contact with the cooling roll 62, the temperature of both the continuous film F and the heat resistive layer 154 is reduced, and the temperature gradient illustrated in (B) of FIG. 6 is formed at the nip exit.

Therefore, the heat deformation of the continuous film F is effectively suppressed. A reduction in image quality caused by heat deformation (expanding or contracting) is effectively suppressed due to the heat deformation of the continuous film F being suppressed.

Second Modification Example

Next, description will be given of the second modification example.

Configuration

A heating transport roll 252 of a heating transport device 250 of the second modification example illustrated in FIG. 7 has a structure which includes a roll main body 251 and a high friction layer 254 which is provided on an outer circumference 251A of the roll main body 251.

The high friction layer 254 is formed of a material with a larger static friction coefficient than the outer circumference 251A of the roll main body 251. For example, the high friction layer 254 is formed of a heat resistive, elastic body such as rubber or an adhesive material. Specifically, the high friction layer 254 may be provided by applying, curing, or alternatively, by adhering a silicone gel, a silicone adhesive, or the like to the outer circumference 251A of the roll main body 251.

Operations and Effects

The part of the continuous film F which is heated to a temperature higher than or equal to the heat deformation temperature at the upstream side of the nip 60 is wound around the high friction layer 254 which has a high static friction coefficient. Accordingly, since the continuous film F is held by the high friction layer 254 and the sliding of the continuous film F is suppressed, the heat deformation of the continuous film F is suppressed. A reduction in image quality caused by heat deformation (expanding or contracting) is effectively suppressed due to the heat deformation of the continuous film F being suppressed.

Third Modification Example

Next, description will be given of the third modification example.

Configuration

In a heating transport device 350 of the third modification example illustrated in FIG. 8, a configuration is adopted in which, even after the continuous film F passes through the nip 60 and separates from the heating transport roll 52, the continuous film F is wound around the cooling roll 62 downstream of the nip 60 in the transport direction. The continuous film F separates from the cooling roll 62 at a separation position 61. Note that, the cooling roll 62 may be a temperature lower than or equal to the heat deformation temperature (100° C. or lower in the present exemplary embodiment, as described above) at the separation position 61 at which the continuous film F separates. In other words, the continuous film F may be a higher temperature than the heat deformation temperature (100° C. in the present exemplary embodiment) at the nip 60.

Operations and Effects

The continuous film F is cooled at the nip 60, and further, is cooled by the cooling roll 62 to a temperature lower than or equal to the heat deformation temperature in a state of being separated from the heating transport roll 52 and not being heated.

Accordingly, in comparison to a configuration in which the continuous film F is not cooled by the cooling roll 62 after separating from the heating transport roll 52, the cooling efficiency is high and the continuous film F is effectively cooled to a temperature lower than or equal to the heat deformation temperature. Therefore, the heat deformation of the continuous film F is effectively suppressed. A reduction in image quality caused by heat deformation (expanding or contracting) is effectively suppressed due to the heat deformation of the continuous film F being suppressed.

Since the heating transport roll 52 may be a higher temperature than the heat deformation temperature at the nip 60, the fluctuation margin of the temperature of the heating transport roll 52 in the circumferential direction is small. Accordingly, even if the transport speed of the continuous film F is increased, the heat source 54 may raise the temperature of the continuous film F to a heat melting temperature or greater using less electrical power than the heating transport devices 50 and 150 illustrated in FIGS. 2 and 5.

Fourth Modification Example

Next, description will be given of the fourth modification example.

Configuration

In a heating transport device 450 of the fourth modification example illustrated in FIG. 9, a configuration is adopted in which, even after the continuous film F passes through the nip 60 and separates from the heating transport roll 52, the continuous film F is wound around a cooling roll 462 downstream of the nip 60 in the transport direction. The continuous film F separates from the cooling roll 462 at a separation position 461.

In the cooling roll 462, the cooling source 64 which is provided on the inner portion of the roll is disposed to be proximal to or to come into contact with an inner circumferential surface 462B which is further to the downstream side than the nip 60. In the present exemplary embodiment, the cooling source 64 is disposed in the proximity of the inner circumferential surface 462B at a position corresponding to the separation position 61 at which the continuous film F separates.

Note that, the cooling roll 462 may be a temperature lower than or equal to the heat deformation temperature (100° C. or lower in the present exemplary embodiment, as described above) at the separation position 461 at which the continuous film F separates. In other words, the continuous film F may be a higher temperature than the heat deformation temperature (100° C. in the present exemplary embodiment) at the nip 60.

Operations and Effects

The continuous film F is cooled at the nip 60, and further, is cooled by the cooling roll 462 to a temperature lower than or equal to the heat deformation temperature in a state of being separated from the heating transport roll 52 and not being heated. Accordingly, in comparison to a configuration in which the continuous film F is not cooled by the cooling roll 462 after separating from the heating transport roll 52, the cooling efficiency is high and the continuous film F is effectively cooled to a temperature lower than or equal to the heat deformation temperature.

The cooling source 64 is disposed in the proximity of the inner circumferential surface 462B at a position corresponding to the separation position 61 at which the continuous film F separates. Accordingly, the cooling roll 62 has a temperature gradient from the nip 60 toward the separation position 461 of the downstream side in the transport direction. Accordingly, since the continuous film F is gradually cooled and separates as the continuous film F moves toward the separation position 461 of the downstream side in the transport direction after separating from the heating transport roll 52, the heat deformation of the continuous film F is more effectively suppressed.

Since the heating transport roll 52 may be a higher temperature than the heat deformation temperature at the nip 60, the fluctuation margin of the temperature of the heating transport roll 52 in the circumferential direction is small. Accordingly, even if the transport speed of the continuous film F is increased, the heat source 54 may raise the temperature of the continuous film F to a heat melting temperature or greater using less electrical power than the heating transport devices 50 and 150 illustrated in FIGS. 2 and 5.

Modification Example of Fixing Device

Next, description will be given of a modification example of the fixing device which configures the image forming apparatus 10.

Configuration

A fixing device 170 of the modification example illustrated in FIG. 10 includes the heating transport roll 52, fixing rolls 172, the cooling roll 82, and a transport roll 92, where the fixing rolls 172 and the cooling roll 82 are urged by the heating transport roll 52. The pair of output rolls 90 are provided on the downstream side of the fixing device 170. Note that, in the present exemplary embodiment, two of the fixing rolls 172 are provided; however, one, or three or more of the fixing rolls 172 may be provided.

The position of a nip 180 between the cooling roll 82 and the heating transport roll 52 is closer to the downstream side in the transport direction than the position of a nip 173 between the heating transport roll 52 and the fixing roll 172 of the downstream side in the transport direction.

The fixing roll 172 rotates in the arrow R direction and is configured such that an outer circumferential surface 172A thereof assumes a predetermined set temperature due to a heat source 174 which is provided in the inner portion of the roll. The continuous film F is interposed between the heating transport roll 52, the fixing rolls 172, and the cooling roll 82, is transported, and is configured to separate from the heating transport roll 52 after passing through the nip 180 between the heating transport roll 52 and the cooling roll 82.

When the continuous film F passes through the nip 173 between the heating transport roll 52 and the fixing roll 172, the temperature of the continuous film F becomes the fixing temperature or higher, and the toner image TA, which is pre-fixed, is fixed to the obverse surface FA of the continuous film F by the heat and pressure.

The cooling roll 82 cools the continuous film F at the nip 180 such that the temperature of the continuous film F becomes lower than or equal to the heat deformation temperature (100° C. or lower in the present exemplary embodiment, as described above). In other words, the temperature of the continuous film F is lower than or equal to the heat deformation temperature thereof at the point in time at which the continuous film F separates from the heating transport roll 52.

Operations and Effects

When the continuous film F onto which the toner image T is pre-fixed by the heating transport device 50 (refer to FIGS. 1 and 2) is interposed between the heating transport roll 52 and the fixing roll 172 of the fixing device 170 and is transported (when the continuous film F passes through the nip 173), the pre-fixed toner image TA is fixed to the obverse surface FA of the continuous film F by the heat and pressure and becomes the toner image TB.

The continuous film F is then cooled to a temperature lower than or equal to the heat deformation temperature in the nip 180 between the heating transport roll 52 and the cooling roll 82, and separates from the heating transport roll 52.

The continuous film F which is separated from the heating transport roll 52 is sent from the fixing device 170 and is output by the output rolls 90.

A tensile force is applied to the continuous film F which is transported in this manner between the fixing device 170 and the output rolls 90. However, as described earlier, after being cooled to a temperature lower than or equal to the heat deformation temperature by the cooling roll 82, the continuous film F is sent from the fixing device 170. In other words, the temperature of the portion of the continuous film F to which the tensile force is applied, between the fixing device 170 and the output rolls 90, is lower than or equal to the heat deformation temperature. Accordingly, for example, the heat deformation of the continuous film F is suppressed (as described later, the stretching rate is less than or equal to the reference value K) in comparison to a case in which the portion of the continuous film F between the fixing device 170 and the output rolls 90 is cooled. A reduction in image quality such as wrinkling caused by heat deformation is suppressed due to the heat deformation of the continuous film F being suppressed.

Second Exemplary Embodiment

In the second exemplary embodiment of the invention, description will be given of an image forming apparatus. Note that, members which are the same as those in the first exemplary embodiment are assigned identical reference numerals, and redundant descriptions will be omitted.

Configuration

An image forming apparatus 710 illustrated in FIG. 11 is provided with an image section 712 and the fixing device 170 (also refer to FIG. 10). A delivery device (not shown) is connected to the left side (the upstream side of the continuous film F (described later) in the transport direction) of the image forming apparatus 710 in FIG. 11, and a take-up device (not shown) is connected to the right side (the downstream side of the continuous film F (described later) in the transport direction) of the image forming apparatus 710 in FIG. 11.

The image forming apparatus 710 forms the toner image TB on the continuous film F, which is an example of a recording medium, using a dry developer W. Note that, the dry developer W of the present exemplary embodiment is a two-component developer formed of toner and carrier particles. However, the dry developer W may be a one-component developer without carrier particles.

The image section 712 which configures the image forming apparatus 710 has substantially the same configuration as in the first exemplary embodiment except in that a developing machine 720 differs, and that the image forming apparatus 710 does not include the second transfer roll 28 (refer to FIG. 1).

The fixing device 170 which configures the image forming apparatus 710 has the same configuration as the fixing device 170 illustrated in FIG. 10 described in the modification example of the first exemplary embodiment.

Operations and Effects

Next, description will be given of the operations and the effects of the present exemplary embodiment.

The toner image T which is formed using the dry developer W is transferred by the image section 712 to the obverse surface FA of the continuous film F which is sent to the image forming apparatus 710 from the delivery device (not shown).

When the continuous film F onto which the toner image T is transferred is interposed between the heating transport roll 52 and the fixing roll 172 of the fixing device 170 and is transported (when the continuous film F passes through the nip 173), the toner image T is fixed to the obverse surface FA of the continuous film F by the heat and pressure and becomes the toner image TB.

The continuous film F is then cooled to a temperature lower than or equal to the heat deformation temperature in the nip 180 between the heating transport roll 52 and the cooling roll 82, and separates from the heating transport roll 52.

The continuous film F which is separated from the heating transport roll 52 is sent from the fixing device 170 and is output by the output rolls 90.

A tensile force is applied to the continuous film F which is transported in this manner between the fixing device 170 and the output rolls 90. However, as described earlier, after being cooled to a temperature lower than or equal to the heat deformation temperature by the cooling roll 82, the continuous film F is sent from the fixing device 170. In other words, the temperature of the portion of the continuous film F to which the tensile force is applied, between the fixing device 170 and the output rolls 90, is lower than or equal to the heat deformation temperature. Accordingly, for example, the heat deformation of the continuous film F is suppressed (as described later, the stretching rate is less than or equal to the reference value K) in comparison to a case in which the portion of the continuous film F between the fixing device 170 and the output rolls 90 is cooled. A reduction in image quality such as wrinkling caused by heat deformation is suppressed due to the heat deformation of the continuous film F being suppressed.

OTHER

Note that, the invention is not limited to the exemplary embodiments described above.

The plural exemplary embodiments and modification examples described above may be carried out in combination, as appropriate.

The technology of the heating transport devices 150, 250, 350, and 450 of the modification examples may be applied to the fixing devices 70 and 170. For example, the heating transport roll 152 or 252 (refer to FIGS. 5 and 7) of the heating transport device 150 or 250 may be used for the heating roll 72 or 172 of the fixing device 70 or 170. As in the heating transport device 350 (refer to FIG. 8), a configuration may be adopted in which, even after passing through the nip 180, the continuous film F is wound around the cooling roll 82. The cooling roll 462 (refer to FIG. 9) of the heating transport device 450 may be used for the cooling roll 72 or 82 of the fixing device 70 or 170.

In the exemplary embodiments and modification examples described above, the recording medium is a continuous film; however, the recording medium is not limited thereto. The recording medium may be a sheet film. The recording medium is not limited to the film material of the exemplary embodiments, and may be a recording medium in which the image quality is reduced by heat deformation when a tensile force is applied to the recording medium in a heated state.

The configuration of the image forming apparatus is not limited to that of the exemplary embodiments described above, and various configurations may be adopted.

Further, it goes without saying that the invention may be assume various exemplary embodiments within a scope which does not deviate from the concept of the invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device, comprising:

a heating transport device including:

(i) a heating transport roll around which a recording medium to which a toner image is transferred is wound, and that transports the recording medium while heating the toner image to a temperature higher than or equal to a melting temperature of toner; and (ii) a cooling roll that forms a nip with the heating transport roll, transports the recording medium, and cools the recording medium such that the temperature of the recording medium is lower than or equal to a heat deformation temperature of the recording medium at a position at which the recording medium separates from the heating transport roll; and a fixing roll that fixes the toner image to the recording medium on an upstream side of the nip of the recording medium in a state of the recording medium being wound around the heating transport roll of the heating transport device.

2. The fixing device according to claim 1, wherein the heating transport roll includes a roll main body that includes a heat source in an inner portion thereof, and a heat resistive layer that is provided on an outer circumference of the roll main body.

3. The fixing device according to claim 2, wherein the recording medium is wound around the cooling roll on a downstream side of the nip in a transport direction.

4. The fixing device according to claim 1, wherein the heating transport roll includes a roll main body, and a high friction layer that is provided on an outer circumference of the roll main body and has a static friction coefficient higher than a static friction coefficient of an outer circumferential surface of the roll main body.

5. The fixing device according to claim 4, wherein the recording medium is wound around the cooling roll on a downstream side of the nip in a transport direction.

6. The fixing device according to claim 1, wherein the recording medium is wound around the cooling roll on a downstream side of the nip in a transport direction.

7. The fixing device according to claim 1, wherein the recording medium is a continuous film or a sheet film.

8. The fixing device according to claim 1, wherein an image quality is reduced by heat deformation when a tensile force is applied to the recording medium in a heated state.

9. An image forming apparatus, comprising:

an image section that forms a toner image using a liquid developer and transfers the toner image to a recording medium;

a heating transport device that heats and transports the recording medium onto which the toner image is transferred by the image section, the heating transport device including:

(i) a heating transport roll around which a recording medium to which a toner image is transferred is wound, and that transports the recording medium while heating the toner image to a temperature higher than or equal to a melting temperature of toner; and (ii) a cooling roll that forms a nip with the heating transport roll, transports the recording medium, and cools the recording medium such that the temperature of the recording medium is lower than or equal to a heat deformation temperature of the recording medium at a position at which the recording medium separates from the heating transport roll; and a fixing device that fixes the toner image to the recording medium on the downstream side of the heating transport device.

* * * * *